US007168337B2

(12) United States Patent
Carmo

(10) Patent No.: US 7,168,337 B2
(45) Date of Patent: Jan. 30, 2007

(54) OPENER FOR THREADED JAR LIDS

(76) Inventor: Robert A. Carmo, 407 Michel Pl., Placentia, CA (US) 92870

( * ) Notice: Subject to any disclaimer, the term of this patent is extended or adjusted under 35 U.S.C. 154(b) by 0 days.

(21) Appl. No.: 10/611,595

(22) Filed: Jun. 30, 2003

(65) Prior Publication Data

US 2004/0261580 A1 Dec. 30, 2004

(51) Int. Cl.
*B67B 7/18* (2006.01)

(52) U.S. Cl. ..... 81/3.43; 81/64

(58) Field of Classification Search ..... 81/3.4, 81/3.43, 64; D8/40
See application file for complete search history.

(56) References Cited

U.S. PATENT DOCUMENTS

| | | | | |
|---|---|---|---|---|
| 1,647,892 | A * | 11/1927 | Viebrock | 81/3.4 |
| 1,919,866 | A * | 7/1933 | Schacht | 81/3.4 |
| 2,246,649 | A * | 6/1941 | West | 81/3.4 |
| 2,554,410 | A * | 5/1951 | Horton | 81/3.4 |
| 3,121,355 | A * | 2/1964 | Morel et al. | 81/3.4 |
| 3,812,741 | A * | 5/1974 | Heine | 81/3.4 |
| 4,058,031 | A * | 11/1977 | Magarian | 81/64 |
| 4,067,279 | A * | 1/1978 | Lester et al. | 53/334 |
| D277,160 | S * | 1/1985 | Antone | D8/40 |
| 4,760,763 | A * | 8/1988 | Trick et al. | 81/3.4 |
| 5,440,957 | A * | 8/1995 | Rogers | 81/3.4 |
| 6,640,665 | B1 * | 11/2003 | Williamson | 81/3.4 |
| 2002/0189408 | A1 * | 12/2002 | McCabe et al. | 81/64 |
| 2004/0261580 | A1 * | 12/2004 | Carmo | 81/3.43 |

* cited by examiner

*Primary Examiner*—Lee D. Wilson
(74) *Attorney, Agent, or Firm*—Donald D. Mon

(57) ABSTRACT

An opener to assist in the opening of a threaded lid from a threaded jar. The opener is a body at least partially to embrace the peripheral wall of a lid. Preferably it allows for an expansion to facilitate application, and a shoulder to be abutted by a thumb or finger to add torque to the removal efforts.

4 Claims, 2 Drawing Sheets

OPENER FOR THREADED JAR LIDS

FIELD OF THE INVENTION

A moderately sized unitary encircling opener to facilitate the removal of a tightly attached threaded lid from a jar.

BACKGROUND OF THE INVENTION

Bottles and jars for containing food are necessarily closed by lids which are tightly threaded on. This is a necessary function to protect the contents from leakage into the jar of harmful substances. In many situations, such as for baby foods, the packaging operation leaves the inside of the jar under a negative pressure in order to secure the tightness. This adds to the force necessary to release the jar. In fact, it is a solid surface to surface contact under substantial compressive load.

Consumers, especially women and new mothers often lack sufficient strength in their hands and wrists to exert the necessary torque on the lid. This is further complicated by the small height of the lid, which provides little area to be gripped. Besides, this area is usually smooth and circular.

This situation has not gone unnoticed, and the market is replete with devices to give some advantage to the person who seeks to open the container. These extend from simple sheets or cones of conformable material to make the grip more comfortable, to plier-like gripping devices that require a squeeze, but also provide leverage. All of these have advantages and disadvantages, but usually they will in fact assist a person to open the jar.

In view of the above, one can reasonably and logically ask why another opener is needed, and whether it can provide any overall advantage beyond what already exists. The applicant herein believes he has done so by providing a small, conveniently applied opener which inherently grips the lid and which in its preferred embodiment includes an abutment readily engaged by the thumb or a finger to exert an additional torque.

It is an object of this invention to provide an opener of relatively small and elegantly simple construction which can be molded to shape and readily used.

BRIEF DESCRIPTION OF THE INVENTION

An opener according to this invention comprises a unitary body of stiffly flexible material, preferably rubber or rubber-like, with an arcuate boundary to fit around a major portion of a lid which it is to grip. It has an inner peripheral wall to engage the lid, and an outer peripheral wall to be engaged by the hand of the user.

According to a preferred but optional feature of the invention, the body extends around less than the full periphery of the lid, leaving a gap between the ends of the arcuate structure. This grip is bridged by an abutment which preferably is U-shaped, that projects outwardly from the outer peripheral wall so as to be engageable by a thumb or finger. Preferably this abutment is stiffly flexible so as to permit limited spreading apart of the ends of the body to facilitate engagement with the lid.

According to yet another preferred but optional feature of the invention, the inner peripheral wall of the body includes a limit stop which will engage a portion of the lid (such as bead around its lower edge) before the lower edge of the body will contact the jar where it could create a drag that would add to the torque necessary to turn the lid.

According to yet another preferred but optional feature of the invention a limit shoulder is incorporated in the body to limit the ultimate passage of the lid into the body.

The above and other features of this invention will be fully understood from the following detailed description and the accompanying drawings, in which:

DETAILED DESCRIPTION OF THE INVENTION

Figure 2:
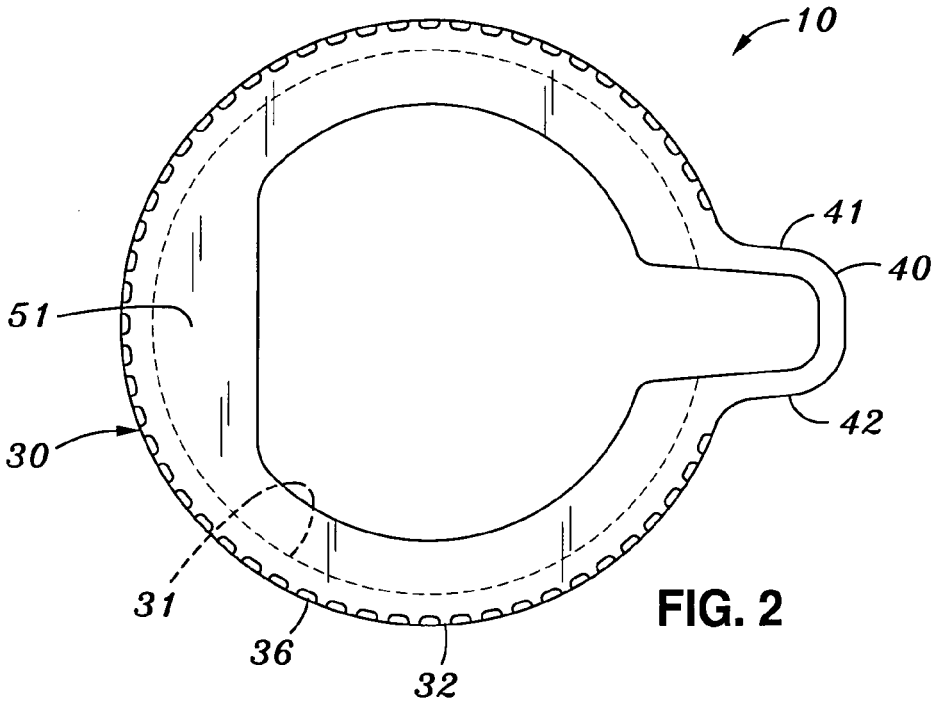
FIG. 2 is a top view taken at line 2—2 in FIG. 1.
Figure 1:
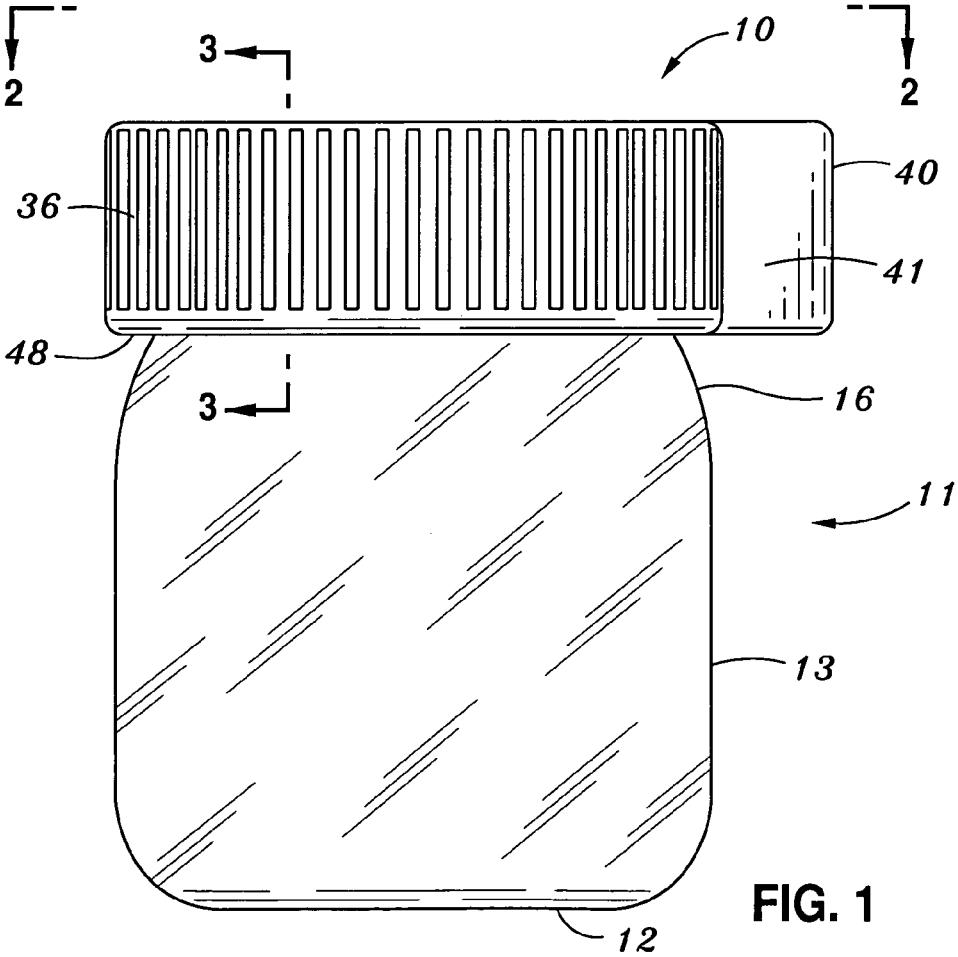
FIG. 1 is a side elevation of the presently-preferred embodiment of the invention, applied to a jar closed by a lid to be removed by the opener of this invention.
Figure 3:
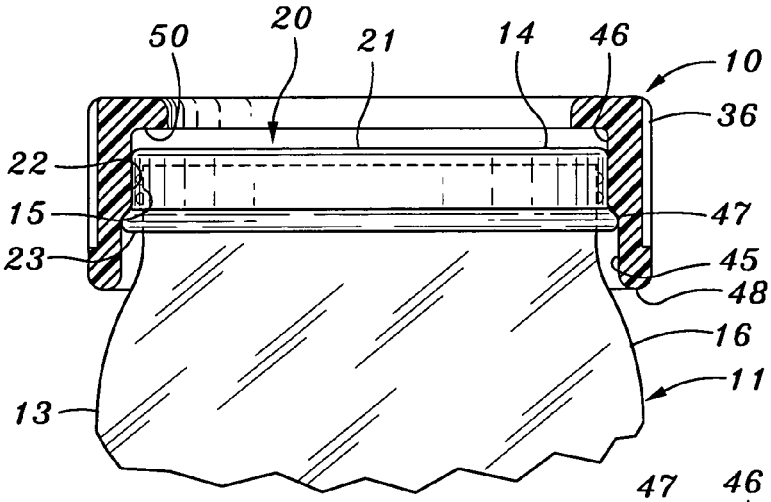
FIG. 3 is a fragmentary cross-section taken at line 3—3 in FIG. 1.

The presently-preferred embodiment of an opener 10 according to this invention is shown in FIG. 1. It is shown in the configuration for the use whose earliest use is anticipated. It is applied to a typical food jar 11. Such a jar has a bottom 12 a peripheral sidewall 13 and an open upper mouth 14 with a thread 15 around it (FIG. 3). A sloping shoulder 16 is formed in the wall below the thread.

A typical lid 20 for this jar has a closed top 21, a peripheral sidewall 22, and a reinforcing peripheral rib 23 at the bottom of its sidewall. An internal thread (not shown) engages the thread on the jar. Frequently the metal lid itself is not threaded. Instead a ring of sealant material is placed inside the lid adjacent to the mouth and the sidewall which solidifies to form a thread-like contour on the jar thread. This both seals the jar and enables removal of the lid by twisting it around the vertical axis of the jar. It is the function of this opener to grasp the lid and transmit torque from the user's hand to the lid.

Opener 10 is a unitary body 30 C-shaped, comprising an internal sidewall 31, external side wall 32, and a gap 33 between ends 34 and 35 of the body. The body is circularly arcuate in plan view. The internal sidewall is dimensioned so as to make a snug fit on the lid when placed around the lid. The internal sidewall will then grip the lid, and the lid can be turned.

The product is preferably made of a rubber or rubber-like material so it is self-shape retaining, but flexible enough that the body can be stretched open to accommodate somewhat larger lids.

Axial grooves 36 are formed in the outer sidewall to provide a firmer grip for the user's hand. The wall thickness of the opener provides a better size for the user to grip, and amplifies the torque on the smaller-diameter lid.

The opener as described above forms a useful embodiment of this invention, and is intended to be encompassed in this invention, useful for all kinds of jars and threaded lids. However, this invention also includes additional features which facilitate its use, which will now be described.

An abutment 40 is unitarily formed as part of the body. It projects beyond the outer sidewall of the body where it can be pressed against by the thumb or finger of the user. For this purpose it has arms 41, 42 formed as sides of an arch that connects the two ends of the body. The arms are connected by a bight 43. This abutment is flexible so as to allow the ends of the body to be spread apart to receive lids of various sizes. It is self-shape retaining, so as to tend to return to its original undistorted shape when no lid is inside it. This is an optional feature. It is shown as a rather rectangular structure. It could instead by a continuous curved arc.

Figure 4:
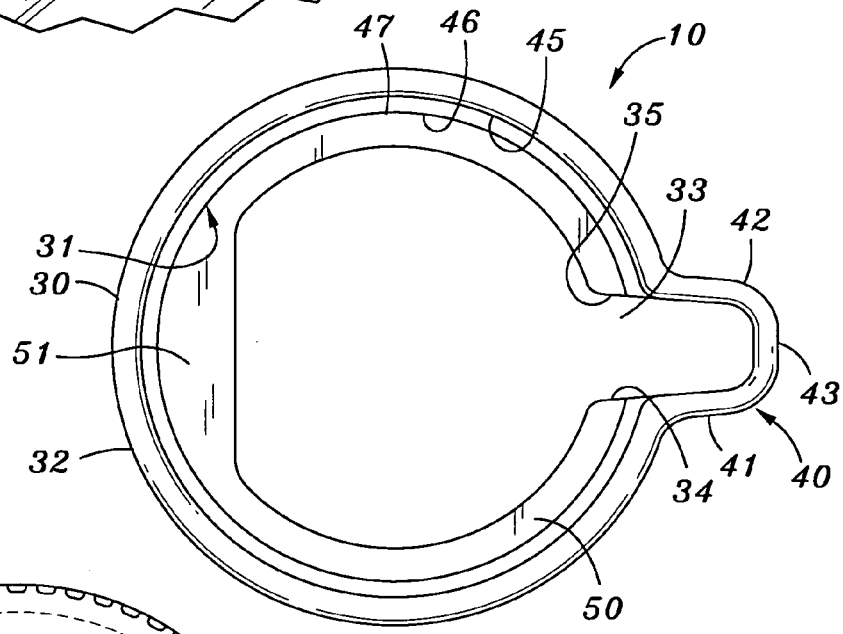
FIG. 4 is a bottom view of the opener of FIG. 1.

Another optional feature is best shown in FIGS. 3 and 4. The inner sidewall 31 has portions 45, 46 of different diameter portion 45 being larger. This forms a shoulder 47 between them. The purpose of this shoulder is to stop the rim 23 before lower edge 48 of the body can strike shoulder 16 of the jar. This prevents the body from pushing down on the shoulder, which would cause a drag that resists the turning of the lid.

Shoulder 47 would not be provided if only lids without a seal were to be removed. Also it is not necessary even when beaded lids are used. It is however, a convenience when lids with beads are to be removed from a jar.

A stop 50 may optionally be formed on the inside top of the body. It forms an ultimate stop for a lid, especially useful when an abutment 47, or a shoulder 16 is not involved. Stop 50 may include a central reinforcement area 51. This will stiffen the body somewhat, and is also available for identification and advertising material.

Figure 5:
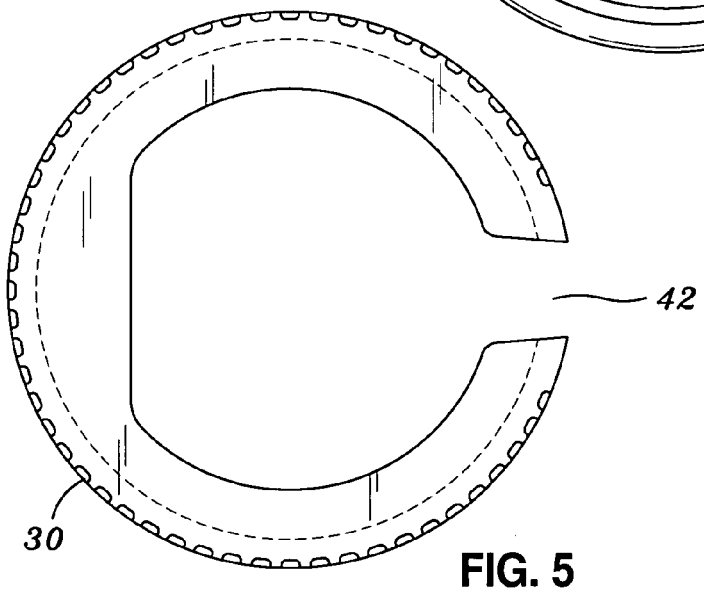
FIG. 5 is a top view of the opener of FIG. 1, modified to illustrate another embodiment of the invention.

FIG. 5 illustrates the simplest embodiment of the invention. It includes only body 20, and not abutment 40. All of the shapes described above can be utilized in the same manner.

Another useful embodiment of the invention (not shown) comprises the construction of FIG. 5 without a gap, but instead a continuous circular structure with the inner surfaces adapted to engage a rim on the lid.

This opener is a conveniently molded, single piece article in all of its embodiments. It may be made of any suitably flexible and agreeable material such as natural and synthetic rubbers, and various organic plastic materials.

The dimensions are arbitrary, and will be made suitable for an intended size or range of sizes. The opener can be provided in sets of several sizes to accommodate a full range of lids.

This invention is not to be limited by the embodiments shown in the drawings and described in the description, which are given by way of example and not of limitation, but only in accordance with the scope of the appended claims.

In the claims:

1. An opener to facilitate the removal of a threaded lid from the top of a jar, said jar having an open mouth surrounded by a thread, said opener comprising a body having an circularly arcuate C-shape with an inner sidewall, an outer sidewall, an upper edge and a lower edge, said body terminating at two ends separated by an open gap, an inwardly extending stop extending along said inner sidewall adjacent to said upper edge, the region inside said inner sidewall being open, said inner sidewall including a pair of portions of different diameter, with the portion of larger diameter being the closer portion to said lower edge, whereby to form a shoulder facing toward said lower edge, said body being made of a stiffly flexible substance which tends to restore itself to an original shape when distortive forces are removed, whereby said body can be spread open at said gap to receive a lid, and released to embrace said lid, thereby to assist a user to remove said lid from said jar, the larger diameter portion facilitating the entry of the lid into the region inside the body; said opener further including an abutment comprising a pair of arms and a bight joining said arms each arm being joined at a respective said end of said body, and said arms being disposed entirely radially beyond said outer side wall, said abutment being springly flexible to enable said ends of the body to be spread apart, but sufficiently strong to assist a user to apply torque to said body to open the jar.

2. An opener according to claim 1 in which said shoulder is so disposed and proportioned as to engage a part of the lid before the lower edge of the body can reach and contact the jar itself.

3. An opener to facilitate the removal of a threaded lid from the top of a jar, said jar having an open mouth surrounded by a thread, said opener comprising a body having a circularly arcuate C-shape with an inner sidewall, an outer sidewall, an upper edge and a lower edge, said body terminating at two ends separated by an open gap, an inwardly extending stop extending along said inner sidewall adjacent to said upper edge, the region inside said inner sidewall being open, said inner sidewall including a pair of portions of different diameter, with the portion of larger diameter being the closer portion to said lower edge, whereby to form a tapered shoulder facing toward said lower edge, said body being made of a stiffly flexible substance which tends to restore itself to an original shape when distortive forces are removed, whereby said body can be spread open at said gap to receive a lid, and released to embrace said lid, thereby to assist a user to remove said lid from said jar, the larger diameter portion facilitating the entry of the lid into the region inside the body, and the tapered portion facilitating entry of the top of the lid into the smaller diameter region.

4. An opener according to claim 1 in which said shoulder is so disposed and proportioned as to engage a lower part of the lid before the lower edge of the body can reach and contact the jar itself.

* * * * *